United States Patent [19]

Rockar

[11] Patent Number: 4,680,905

[45] Date of Patent: Jul. 21, 1987

[54] RAFTER WITH INTERNAL DRAINAGE FEATURE AND SLOPED GLAZING SYSTEM INCORPORATING SAME

[75] Inventor: James A. Rockar, Tarentum, Pa.

[73] Assignee: PPG Industries, Inc., Pittsburgh, Pa.

[21] Appl. No.: 768,985

[22] Filed: Aug. 26, 1985

[51] Int. Cl.[4] ..... E04B 7/18

[52] U.S. Cl. ..... 52/200; 52/209; 52/464

[58] Field of Search ..... 52/200, 209, 397, 459, 52/464, 465, 466, 467, 469

[56] References Cited

U.S. PATENT DOCUMENTS

| | | | |
|---|---|---|---|
| 3,830,029 | 8/1974 | Vance | 52/464 X |
| 3,844,087 | 10/1974 | Schultz et al. | 52/200 |
| 4,055,923 | 11/1977 | Biebuyck | 52/235 |
| 4,070,806 | 1/1978 | Hubbard | 52/95 |
| 4,114,330 | 9/1978 | Sukolics | 52/200 |
| 4,182,376 | 1/1980 | Nilsson | 52/16 X |
| 4,276,729 | 7/1981 | Shiga et al. | 52/209 |
| 4,448,001 | 5/1984 | Whitmyer et al. | 52/209 |
| 4,471,584 | 9/1984 | Dietrich | 52/209 |

*Primary Examiner*—William F. Pate, III
*Assistant Examiner*—Creighten Smith
*Attorney, Agent, or Firm*—Donald C. Lepiane; Robert A. Westerlund, Jr.

[57] ABSTRACT

A sloper curtainwall or glazing system for a building or the like includes a plurality of rafters and purlins interconnected together to provide at least one panel opening for retaining a panel. The rafters have an upwardly sloping vertical glazing pocket adapted to receive a vertical marginal edge portion of a panel and the purlins have a horizontal glazing pocket adapted to receive a horizontal marginal edge portion of a panel. The rafters each further include a semi-enclosed drainage channel and a condensation gutter not disposed in fluid communication with either said drainage channel or said vertical glazing pocket. The purlins further include a condensation gutter. The purlin and rafter condensation gutters are disposed in fluid communication with each other and the drainage channel is provided with at least one opening to put the vertical and horizontal glazing pockets in communication therewith. The glazing system further includes a sill having facilities for separately collecting, and discharging to the exterior of the glazing system, all of the infiltration moisture collected in the drainage channel and all of the condensation moisture collected in the rafter condensation gutter.

1 Claim, 11 Drawing Figures

RAFTER WITH INTERNAL DRAINAGE FEATURE AND SLOPED GLAZING SYSTEM INCORPORATING SAME

FIELD OF THE INVENTION

The present invention relates generally to sloped glazing systems, and more particularly, to a sloped glazing system having rafters provided with internal drainage channels for zonally collecting and draining infiltrated moisture and gutters for separately collecting and draining condensate moisture.

BACKGROUND OF THE INVENTION

Sloped or overhead glazing systems generally include a plurality of horizontal framing members or purlins and vertical framing members or rafters interconnected to form a structural framing grid which provides a plurality of glazing openings into which architectural panels, e.g. glass panels, are secured. The framing grid is attached to a building superstructure. The grid usually has a slope or pitch of about 15° to about 75° as measured from the horizontal plane of the superstructure. Typically, each purlin and each rafter consists of two primary parts, one on the inside of the panels and one on the outside of the panels. The primary parts are interconnected to form glazing recesses or pockets adapted to receive and retain marginal edge portions of the panels. Various forms of connector and sealing components are employed to secure the panels within the glazing pockets and to minimize infiltration of moisture, air, dust, and other elements, from the outside to the inside of the glazing pockets. Typical sealing components comprise resilient sealing gaskets which grip the inner and outer panel surfaces. The tightening force applied to the connector components to interconnect the inside and outside primary parts of the purlins and rafters compressively biases the panel gripping gaskets against the inside and outside panel surfaces to securely retain the glazing panels within the framing grid and to minimize penetration of moisture, air, and the like into the glazing pockets and the building interior. However, if water, e.g. rain water and/or window washing water, leaks past the outside sealing gaskets and builds up in the glazing pockets, then columnar water pressure may force the water around the inside sealing gaskets and into the building interior, which may cause damage to the building interior and/or objects contained therewithin.

Presently available glazing systems provide facilities for collecting and draining moisture which penetrates past the outside sealing gaskets into the glazing pockets. U.S. Pat. No. 4,448,001 issued to Whitmeyer et al. teaches a moisture dam system for vertical curtain walls which includes insertion of vertical dams near the ends of the horizontal frame members to prevent discharge of water accumulated in the horizontal members through the ends of the horizontal members and into other zones of the curtain wall frame system. The collected water is discharged through weep openings provided in the horizontal members to the outside of the curtain wall. U.S. Pat. No. 3,719,014 discloses a similar moisture control system for curtain walls, employing end cap members for the horizontal members rather than the inserted vertical dams. U.S. Pat. Nos. 4,448,001 and 3,719,014 suffer common disadvantages. First of all, if the water builds up in the horizontal members faster than it can be discharged therefrom, then the water will exert pressure against and eventually leak past the interior sealing gaskets and into the building interior. Secondly, no provisions are made to handle water buildup within the vertical frame members and glazing pockets. U.S. Pat. No. 4,055,923 issued to Biebuyck teaches the use of water diverters mounted internally of the horizontal mullions of a curtain wall framing system for diverting intruding water to exit points on the exterior sides of the mullions. At the crossings of vertical and horizontal mullions, internal diverter bridge pieces connect the water diverters of adjacent horizontal mullions to thereby divert water from the vertical mullions to the horizontal mullion diverter network. A disadvantage of this water diversion system is that the combined water which infiltrates the vertical and horizontal mullions is diverted through just the horizontal mullions. If the water builds up within the horizontal mullions faster than it can be discharged therefrom, then the water will exert pressure against and eventually leak past the interior sealing gaskets into the building interior.

U.S. Pat. Nos. 4,114,330 and 4,070,806 teach sloped curtain wall or skylight systems wherein gutters integral to the framing members (e.g. the rafters) function to collect some of the infiltrating moisture and moisture which may result from condensation within the framing members or on the surfaces of the glass panels due to changes in atmospheric pressure and/or temperature. The collected moisture is directed along the gutters which extend continuously over the length of the rafters and/or purlins and into a sill member disposed at the bottom of the sloped curtain wall. The accumulated moisture collected from the framing members by the gutters is then discharged from the sill member to the outside of the building wherein the curtain wall is installed. A drawback of the moisture control system of these sloped curtainwall systems is that both condensate moisture and infiltrating moisture are collected and discharged in a common moisture control system, thereby requiring a greater sill discharge capacity. Further, if the accumulated moisture builds up faster than the capacity of the sill member to discharge it to the outside, then the moisture may form a water column within the gutters. The water column exerts pressure on the inside sealing gaskets and some water eventually leaks past the sealing gaskets and into the building interior. Another shortcoming of these moisture control systems is that some moisture is allowed to pass into the glazing pockets, with the consequence that if discharge of the moisture is not rapid enough, the moisture will form a column of water within the glazing pockets which may, like the standing water in the gutter network, leak past the inside sealing gaskets and into the building interior. The problem of water buildup is more pronounced in multi-story installations and when the pressure within the framing system is less than the outside atmospheric pressure, as the negative pressure draws moisture into the framing system.

It would therefore be advantageous to have a sloped glazing system having an internal drainage system which precludes the possibility of moisture buildup in the glazing pockets and which provides systematic, separate zonal collection and drainage of infiltrated and condensate moisture.

SUMMARY OF THE INVENTION

The present invention includes a sloped glazing system having a plurality of horizontal framing members or purlins and vertical framing members or rafters interconnected together to form a sloped structural framing grid which is attached to a building superstructure or vertical curtainwall system. The purlins and rafters cooperatively function to securely retain panels, e.g. glass panels, within the structural framing grid. Each of the rafters and each of the purlins preferably include two primary pieces or parts, one on the interior side of the panels, and one on the exterior side of the panels. However. in some glazing applications, the rafters and/or purlins may be comprised of one piece. The interior and exterior primary parts of the rafters and purlins are joined together by any convenient connector component(s) to form glazing pockets adapted to capture marginal peripheral portions of the panels. Various forms of auxiliary parts are employed to hold sealing components to bear against the inside and outside surfaces of the panels around the marginal periphery thereof. The sealing components suitably comprise resilient sealing gaskets. The tightening force applied to the connector components to join the interior and exterior primary parts of the rafters and purlins compressively biases the sealing gaskets into gripping engagement with the inner and outer surfaces of the panels to securely retain the panels within the horizontal and vertical glazing pockets provided by the purlins and rafters, respectively. The outside sealing gaskets serve to minimize penetration of moisture, air, dust, dirt, or the like from the outside of the glazing system into the glazing pockets. The inside sealing gaskets similarly ensure the weathertightness of the building interior wherein the sloped glazing system is installed.

In accordance with the present invention, the rafters each preferably comprise, after assembly of the interior and exterior parts thereof, an elongated structural framing member having a vertical glazing pocket, a structural portion, and a semi-enclosed drainage channel disposed adjacent to the glazing pocket. The term "semi-enclosed drainage channel" as used herein and throughout the specification and claims, means a chamber which is fully enclosed at least over a portion of its length. The semi-enclosed drainage channel includes a pair of opposed side walls, an outer wall disposed adjacent to the glazing pocket, and an inner wall disposed nearer to the building interior. The outer wall of the drainage channel may either be integral to the other walls of the channel or may be provided by a separate element, e.g. by the connector component which joins the interior and exterior primary parts of the rafter. In any instance, the outer wall of the drainage channel is open and the connector component interrupted at the rafter-purlin crossings to accommodate the interconnection of the rafters and purlins, at their crossings, in a preferred manner. Therefore, the semi-enclosed drainage channel essentially comprises an enclosed chamber extending continuously over the entire length of the rafter, except that the chamber is open at each of the rafter-purlin crossings. The rafters preferably extend continuously along the vertical dimension (i.e. in the direction of the slope) of the sloped glazing system. The purlins may extend continuously over one or more rafters along the horizontal dimension of the sloped glazing system or be entirely discrete, i.e. extend only between adjacent ones of the rafters. The purlins each preferably comprise, after assembly of the interior and exterior primary parts thereof, an elongated structural framing member having a horizontal glazing pocket and a structural portion. The horizontal glazing pockets are put in fluid communication with the semi-enclosed drainage channels at the rafter-purlin crossings.

The moisture control internal drainage feature of the sloped glazing system of this invention works in the following preferred manner. Any moisture which leaks past the outside sealing gaskets into the vertical glazing pockets flows downwardly along the outer wall of the drainage channels due to gravity and the sloped contour or configuration of the rafters. When the intruded water reaches the next lower opening in the outer wall of the drainage channel it flows thereinto. All of the moisture which intrudes the vertical glazing pockets associated with any given rafter is thereby conducted into the continuously extending drainage channel associated with that particular rafter. Therefore, all moisture which intrudes the vertical glazing pockets of the rafters is collected and accumulated within the substantially enclosed drainage channels rather than within the vertical glazing pockets, thereby precluding buildup of water within the vertical glazing pockets.

Further, all of the moisture which intrudes the horizontal glazing pockets of discrete purlins is preferably routed into the rafter drainage channels by way of the intruded moisture which is collected and accumulated within the horizontal glazing pockets flowing out of the end of the purlins, at the purlin-rafter crossings, and into the drainage channels. In the instance of continuous purlins, the intruded moisture is routed from the horizontal glazing pockets into the rafter drainage channels in the same manner as just described with regard to discrete purlins, except that the intruded moisture is discharged through openings provided through the purlins at the purlin-rafter crossings. The purlin openings are disposed in fluid communication with the openings provided through the outer wall of the drainage channels, thereby enabling the discharged intruded moisture to flow into the rafter drainage channels. Approximately half of the accumulated moisture present in the horizontal glazing pockets disposed adjacent opposite sides of a given rafter will be discharged in the previously described manner into the drainage channel associated with that particular rafter. In this manner, all of the intruded water present throughout the entire sloped glazing system is zonally collected in the rafter drainage channels.

Yet further, each of the rafters preferably further includes a gutter or drainage trough disposed interiorly adjacent to opposite sides of the vertical glazing pocket. The rafter gutters preferably do not fluidly communicate with either the drainage channels or the glazing pockets. The oppositely disposed gutters associated with each rafter preferably extend continuously along the entire length of the rafters. The purlins each preferably further include a gutter or drainage trough interiorly adjacent to at least the upstream side of the horizontal glazing pocket, but not in fluid communication therewith. The purlin gutters are interrupted at each of the rafter-purlin crossings to accommodate the interconnection of the rafters and purlins in a preferred manner. The purlin gutters preferably extend beyond an outside lip portion of the adjacent rafter gutters to put the purlin gutters in fluid communication with the rafter gutters. The purlin and rafter gutters cooperatively function to zonally collect all of the moisture which is formed by condensation on the interior surfaces of the panels and within portions of the purlins and rafters, within the continuously extending rafter gutters.

Separate facilities are provided for draining, and discharging to the exterior of the sloped glazing system, all of the condensate moisture zonally collected in the rafter gutters and all of the intruded moisture zonally collected in the rafter drainage channels. The condensate moisture discharge facilities preferably include discharge ports which have a check valve mounted therein to allow the collected moisture to flow therethrough to the outside of the sloped glazing system, but prohibit inflow of moisture, air, dust, dirt, or the like, from the outside to the inside of the building wherein the sloped glazing system is installed.

Another preferred feature of the present invention is the utilization of the theory of "rain screen and pressure equalization" to minimize intrusion of moisture from the outside to the inside of the sloped glazing system. Accordingly, the purlins are preferably provided with air pressure equalization vents to allow the air pressure inside and outside of the rafters and purlins to equalize, to thereby minimize intrusion of moisture, e.g. rain water and the like, into the rafters and purlins, especially moisture which would otherwise intrude if negative pressure developed within the glazing pockets.

DESCRIPTION OF THE INVENTION

Figure 1:
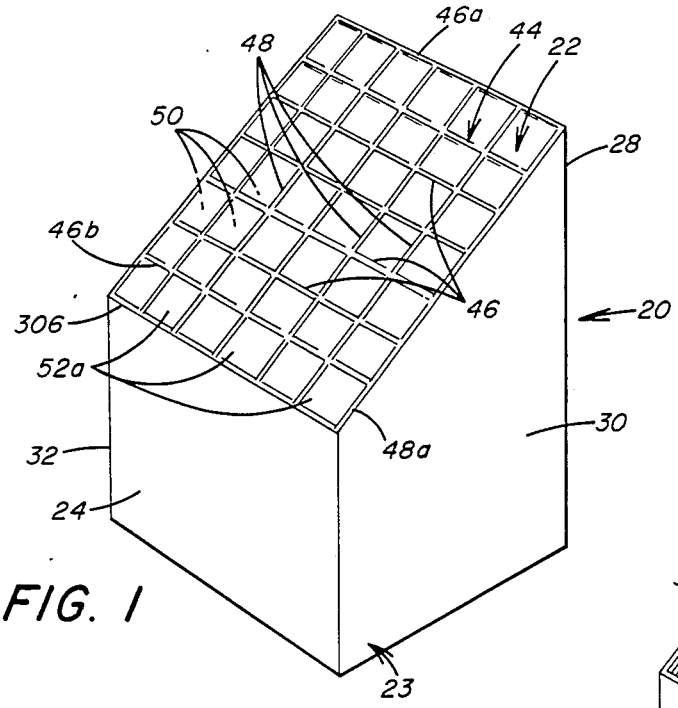
FIG. 1 is a diagrammatic, perspective illustration of a building having a sloped glazing system incorporating features of the present invention installed therein.

In FIG. 1, there is diagrammatically shown a building 20 having the sloped glazing system 22 of the present invention installed therein. Although the sloped glazing system 22 is depicted in FIG. 1 as being of the single-slope type, this configuration is not limiting to the present invention. For example, the sloped glazing system 22 may be of the gable type; the multi-sloped type; or the barrel vault type, or any other configuration or style which is consistent with prevailing architectural and/or building industry standards. The building 20 can suitably be of any convenient style, motif, or design, and is herein depicted as being of a high rise, monolithic construction. The type and/or construction of the building does not form any part of the instant invention, and is not limiting to the invention. The vertical walls 24, 28, 30, and 32 of the building 20 can suitably be vertical curtain walls, e.g. of the type sold by PPG Industries, Inc. under its registered trademark EFG ®. However, the type and/or construction of the vertical walls 24 is not limiting to the present invention, e.g. the vertical walls may be load-bearing or foundational walls constructed of any suitable building material, e.g. wood, metal, concrete, masonry, or the like.

Figure 2:
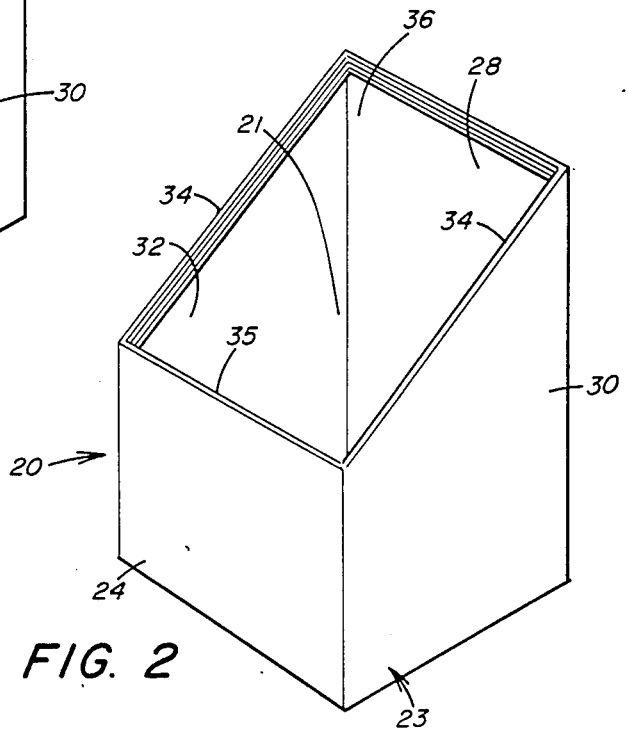
FIG. 2 is a perspective view of the building shown in FIG. 1, without the sloped glazing system installed therein.

The sloped glazing system 22 is adapted to be integrated with the building envelope or superstructure 23, in any convenient manner, to provide a sloped, overhead wall. For example, and not limiting to the invention, the building envelope or superstructure 23 comprises, as illustrated in FIG. 2, a first vertical wall 24, a second vertical wall 28 opposite to and longer/taller than the first vertical wall 24, and oppositely disposed third and fourth vertical walls 30, 32, respectively, each having an angled or sloped upper edge 34. The first, second, third, and fourth vertical walls 24, 28, 30, and 32 are joined or interconnected together to enclose the building interior 21, and to define a roof opening 36 at the top of the building 20. If the vertical walls are foundational (e.g. made of masonry or concrete), a masonry or concrete curb 35 may be provided around the interior perimeter of the walls to define the roof opening 36 and to provide a surface for facilitating attachment of the sloped glazing system 22 to the building superstructure 23 in a manner as will hereinafter be more fully developed. If the vertical walls are curtainwalls, then the sloped glazing system 22 may be integrated with the vertical curtainwalls in a somewhat different manner, as will also be hereinafter fully developed. In any instance, the sloped glazing system 22 may be employed to cover the roof opening 36 or any portion(s) thereof, to thereby provide the roof or a portion of the roof of the building 20.

Referring again to FIG. 1, the sloped glazing system 22 includes a structural framing grid 44 comprised of a plurality of horizontal framing members or purlins 46 and vertical framing members or rafters 48 interconnected together to provide a plurality of glazing openings 50. The rafters 48 and purlins may be made of formed or rolled steel, stainless steel, extruded aluminum, or any other convenient material. The framing grid 44 has a pitch or slope of any suitable grade, e.g. from about 15° to about 75° as measured from the horizontal plane of the building 20. Architectural panels 52 are installed within the glazing openings 50. The architectural panels 52 may be made of any building material, e.g., glass, plastic, metal, cementitious slabs, or any other material suitable for sloped glazing installations. The panels 52 are preferably made of glass. The glazing panels 52 may be single or multiple-glazed and may have any desired features, e.g. optical, strength, safety, solar energy control, or other properties, and may be transparent, opaque, colored, or tinted. The type of panels 52 employed in the practice of the invention, is not limiting to the present invention. However, in the context of sloped or overhead glazing systems, safety considerations and/or building codes may impose certain limitations on the type of glazing panels which may be employed.

Figure 3:
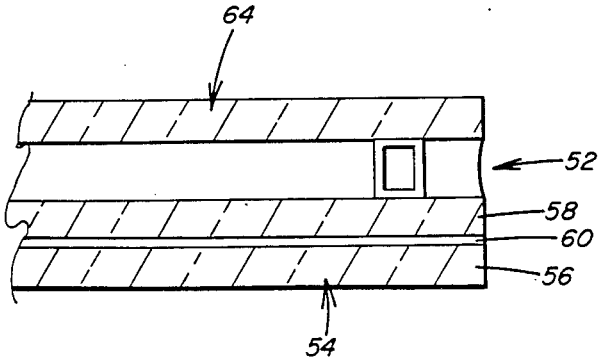
FIG. 3 is a fragmentary, transverse cross-sectional view of a laminated safety panel which may be used in the practice of the invention.

Referring also now to FIG. 3, a typical glazing panel 52 which is employed in sloped or overhead/skylight glazing systems comprises a multiple-glazed unit having an inside panel 54 and an outside panel 64, the inside panel 54 being comprised of a pair of glass sheets 56, 58 having an intermediate layer or interlayer 60 made of plastic, vinyl, polyurethane, or any other suitable material, sandwiched therebetween in any convenient manner as is well known in the pertinent art, to thereby provide a laminated safety panel. The glass sheets 56, 58 can be colored, tinted, coated, clear, heat or chemical strengthened, tempered, or have other strength, optical, and/or solar control properties appropriate to the sloped glazing system installation milieu. The outside panel 64 can comprise a single sheet of glass or two or more sheets of glass laminated together with interlayers of plastic or vinyl material or the like. The outside panel 64 can be strengthened, tinted, coated, colored, or have other strength, optical and/or solar control properties appropriate to the environment in which the sloped glazing system 22 is employed.

Figure 4:
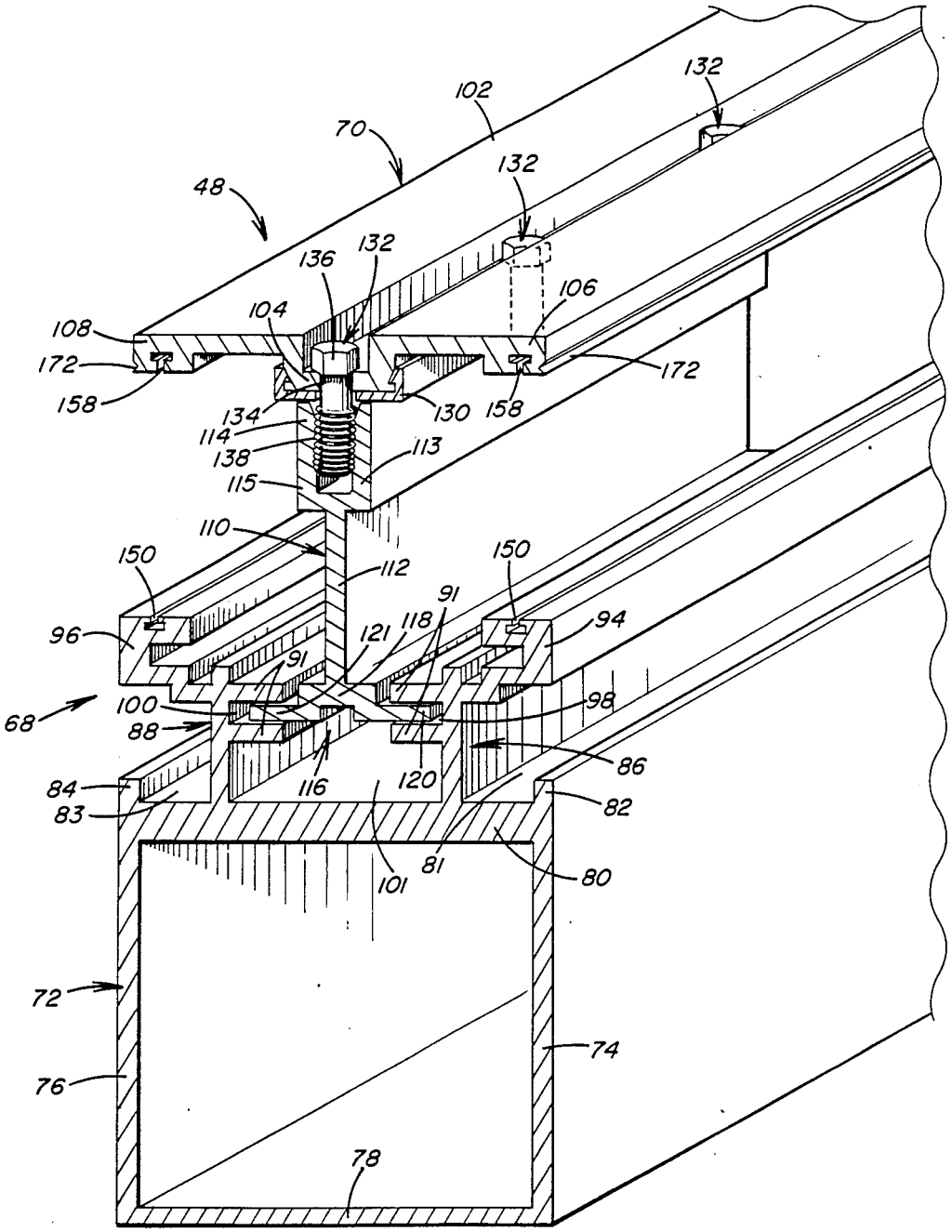
FIG. 4 is a sectional, perspective view of a rafter incorporating features of this invention, and employed in the sloped glazing system shown in FIG. 1.
Figure 5:
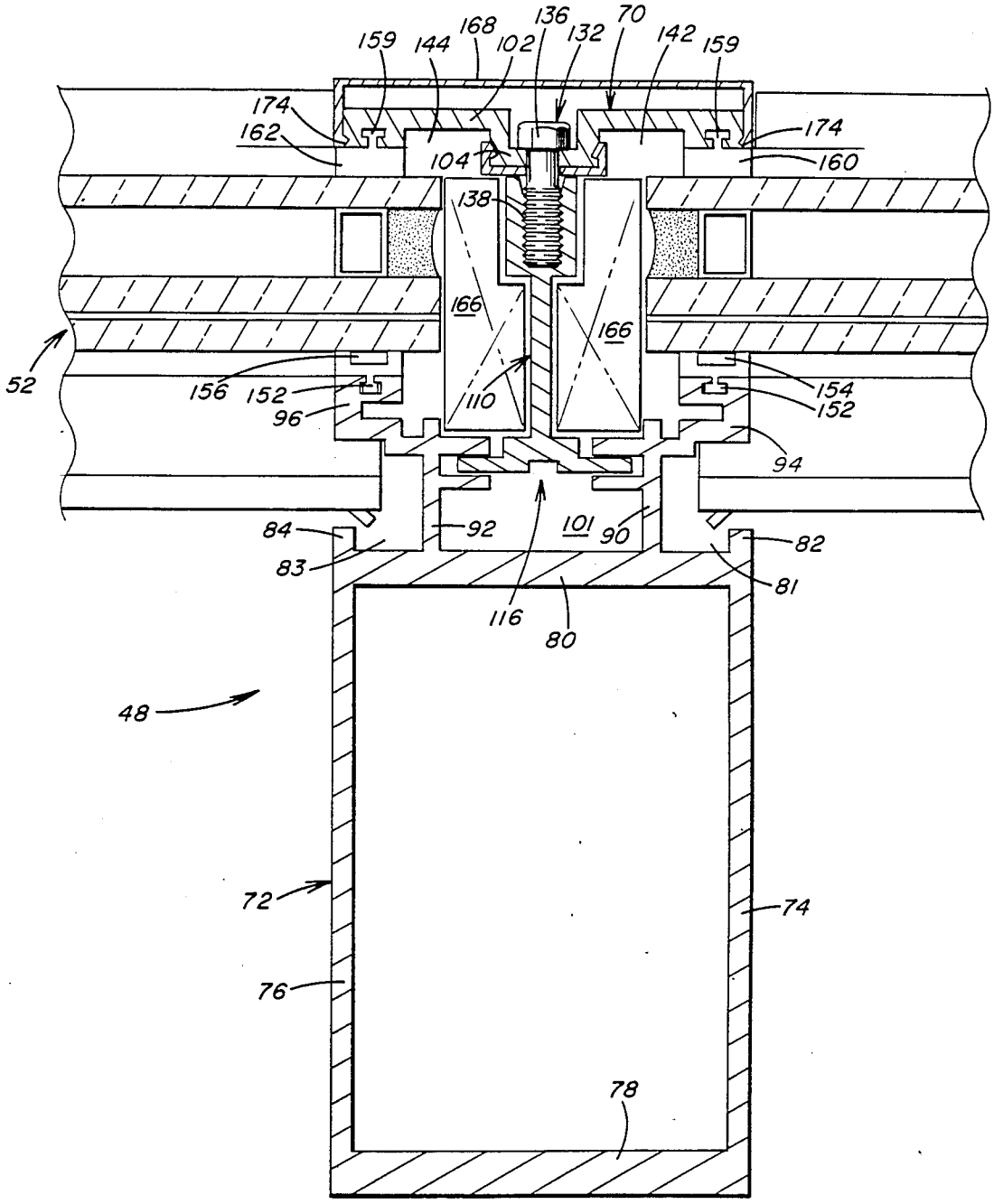
FIG. 5 is an end, cross-sectional view of the rafter shown in FIG. 4, with horizontally adjacent panels and edge blocks secured within the vertical glazing pockets thereof.

A preferred embodiment of a rafter 48 constructed in accordance with this invention is shown in FIGS. 4 and 5. The rafter 48 is there shown to include two main or primary pieces or parts 68 and 70, one on the inside of the panels 52 and one on the outside of the panels 52, respectively. However, the rafters 48 may suitably be of any convenient construction, e.g. one piece or multiple piece construction.

As shown in FIG. 4, the inside primary part 68 of the rafter 48 comprises a structural portion 72 of generally tubular transverse cross-section. However, the structural portion 72 configuration is not limiting to the invention. For example, the structural portion 72 may have a generally I- or H- shaped transverse cross-section, or may be comprised of longitudinally adjacent, upwardly sloping side frame members joined along their sides to provide a structural portion, such as taught in U.S. Pat. No. 4,114,330, which teachings are herein incorporated by reference. The structural portion 72 includes upstanding side walls 74, 76 integrally joined together by inner end wall 78 and outer end wall 80. The outer end wall 80 is preferably slightly inset or recessed from the outer edges of the side walls 74, 76 to provide continuous, upstanding lip portions 82, 84 at opposite sides of the outer end wall 80. The outer end wall 80 and the lip portions 82, 84 define condensation gutters or troughs 81, 83, respectively, for receiving and collecting any condensation which may occur on the inner surface of horizontally adjacent ones of the panels 52. The inside primary part 68 of the rafter 48 preferably further includes a pair of spaced-apart upstanding flanges 86, 88 extending longitudinally along preferably the entire length of the outer end wall 80 of the structural portion 72 of the rafter 48. The flanges 86, 88 include opposed/facing, upstanding, generally F-shaped walls 90, 92, respectively, and gasket lock flange portions 94, 96 extending laterally outwardly from an upper end portion of the walls 90, 92, respectively. The lock flange portions 94, 96 are intermittently interrupted at the intersections or crossings of the rafters 48 and the purlins 46, to accommodate the interconnection of the rafters 48 and the purlins 46, in a preferred manner, as will hereinafter be fully developed. The laterally projecting legs 91 of the F-shaped walls 90, 92 define opposed/facing longitudinal channels or grooves 98, 100 preferably extending along the entire length of the inner surface of the walls 90, 92, respectively, of the upstanding flanges 86, 88.

The outside primary part 70 of the rafter 48 comprises, as shown in FIGS. 4 and 5, a longitudinal plate-like member 102 having a central recessed portion 104 and inturned gasket lock flanges 106, 108 formed at opposite side edges of the member 102. The inside primary part 68 and the outside primary part 70 of the rafter 48 are connected or joined together in any convenient fashion. In the preferred embodiment of the instant invention shown in FIG. 4, a connector component or strip 110 is employed to effect this interconnection. The connector strip 110 includes an upstanding, longitudinally elongated web 112 having a preferably integrally formed, elongated, generally channel-shaped fastener spline 114 extending along its upper edge, and a preferably integrally formed, longitudinally elongated flange 116 extending along its bottom edge. The flange 116 preferably includes a generally inverted U-shaped structural stiffener portion 118 and longitudinally elongated tongues 120, 121 projecting laterally outwardly from the bottom edge of the legs of the inverted U-shaped structural stiffener portion 118. The tongues 120, 121 are dimensioned to groovingly engage the facing grooves 98, 100 of the upstanding flanges 86, 88 extending longitudinally along the outer end wall 80 of the structural portion 72 of the inside primary part 68 of the rafter 48. The tongue-in-groove engagement of the tongues 120, 121 with the grooves 98, 100 interlockingly connects the connector strip 110 to the inside primary part 68 of the rafter 48. Further, the recessed portion 104 of the member 102 of the outside primary part 70 is adapted to interlockingly engage a longitudinally elongated thermal isolator strip 130 made of polyvinyl-chloride (i.e. PVC) or any other suitable thermally non-conductive material, to minimize conduction of heat from the outside to the interior of the building 20 through the rafters 48. The provision of the thermal isolator strip 130 is not limiting to the invention. The outside primary part 70 and the inside primary part 68 of the rafter 48 are interconnected or joined together by means of a plurality of fasteners, e.g. cap screws 132, inserted through a plurality of aligned openings 134 provided through the central recessed portion 104 of the member 102 and the thermal isolator strip 130. The cap screws 132 include a head portion 136 which seats within the central recessed portion 104 and a threaded shank portion 138 which extends downwardly through the aligned openings 134 and into the fastener spline 114 of the connector strip 110. The cap screws 132 may be self-tapping or the fastener spline 114 may be machine-threaded to threadingly receive the shank portion 138. In the embodiment of the invention shown in FIGS. 4 and 5, the cap screws 132 are self-tapping and are provided at appropriate intervals along the length of the connector strip 110. The inner, upper edge of the opposed walls 113, 115 forming the channel of the channel-shaped fastener spline 114 are preferably chamfered or beveled to help start the threading of the fastener spline when self-tapping screws are employed. However, the type of means employed to connect the outside primary part 70 to the inside primary part 68 is not limiting to the invention.

The inside and outside primary parts 68, 70 of the rafter 48 define longitudinally extending vertical glazing pockets 142, 144 therebetween, adjacent to opposite sides of the connector strip 110. The vertical glazing pockets 142, 144 are adapted to receive vertical marginal edge portions of horizontally adjacent ones of the panels 52. The gasket lock flange portions 94, 96 of the flanges 86, 88 carried by the outer end wall 80 of the structural portion 72 of the rafter 48 are each provided with a keyway-like slot 150 adapted to interlockingly engage key-like projections 152 provided on resilient, longitudinally elongated glazing or sealing gaskets 154, 156. The gasket lock flanges 106, 108 of the outside primary part 70 are each provided with a keyway-like slot 158 adapted to interlockingly engage key-like projections 159 provided on resilient, longitudinally elongated glazing or sealing gaskets 160, 162. The tightening force applied to the cap screws 132 to interconnect the inside and outside primary parts 68, 70 compressively biases or urges the outer sealing gaskets 160, 162 to bear inwardly and seal against the outer surface of the vertical marginal edge portions of the horizontally adjacent panels 52, and urges the inner sealing gaskets 154, 156 to bear outwardly and seal against the inner surface of the vertical marginal edge portions of the horizontally adjacent panels 52, to securely retain the vertical marginal edge portions of the panels 52 within the vertical glazing pockets 142, 144.

The outer sealing gaskets 160, 162 serve to minimize penetration of moisture, air, dirt, dust, or the like from the outside of the sloped glazing system 22 to the inside of the vertical glazing pockets 142, 144. The inner sealing gaskets 154, 156 serve to minimize penetration of moisture, air, or the like from the vertical glazing pockets 142, 144 to the interior of the building 20. The outer sealing gaskets 160, 162 and the inner sealing gaskets 154, 156 can be constructed of any convenient weatherproofing material, such as, for example, neoprene or silicone. The type of sealing gaskets employed is not limiting to the invention. For example, the sealing gaskets 160, 162 and/or the sealing gaskets 154, 156 may be of the drive-in, wedge-type, or any other convenient type or form of weatherstripping and/or caulking material.

Referring still to FIGS. 4 and 5, each of the vertical glazing pockets 142, 144 of each of the rafters 48 is preferably provided with resilient edge blocks 166 secured therein at appropriately spaced intervals to protect and stabilize the panels 52 against windloads, structural loads, thermal loads, etc. The type or number of edge blocks 166 employed is not limiting to the invention. For example, one edge block 166 made of dense [e.g. 40±5 durometer (Shore A)] neoprene or other convenient material may be provided within each glazing pocket 142, 144 at the midpoint of each panel 52 (i.e. intermediate each vertically adjacent rafter 48-purlin 46 intersection or crossing). Further, each rafter 48 is preferably provided with an outside trim cover element 168 to protect the cap screws 132 and to enhance the aesthetic appearance and weathertight integrity of the sloped glazing system 22. The trim cover elements 168 may be of any convenient type, style, or configuration, and may be fastened to the rafters 48 in any convenient manner. A preferred trim cover element 168 is generally U-shaped and is adapted to be snap-locked to the associated rafter 48. For example, opposite outer surfaces of the member 102 of the outside primary part 70 of the associated rafter 48 are provided with detents or recesses 172 adapted to interlockingly engage inturned ridges 174 provided on the inner surface of the U-shaped trim cover element 168 at the opposite marginal ends thereof. Similarly, inside trim cover elements (not shown) may also be provided for covering the inside primary part 68 of the rafters 48.

Figure 6:
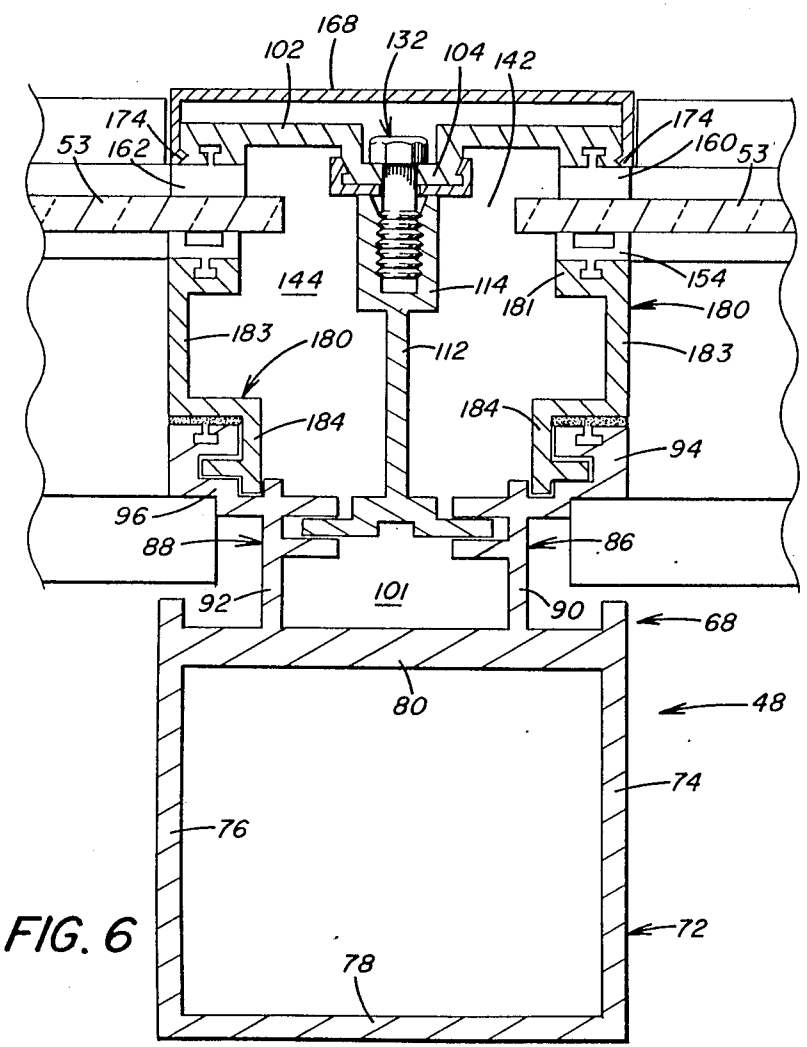
FIG. 6 is the same view as FIG. 5, except that the panels are single-glazed.

Referring now to FIG. 6, there is shown a rafter 48 supporting vertical marginal edge portions of horizontally adjacent panels 53 within its vertical glazing pockets 142, 144. The panels 53 are single-glazed, and therefore, of lesser thickness than double glazed panels. Accordingly, snap-in extension or filler elements 180 are employed to accommodate the panel thickness difference. The filler elements 180, as shown in FIG. 6, each comprise a generally L-shaped member having an inwardly directed gasket lock flange portion 181 at the distal end of the vertical leg 183 thereof, and a downwardly depending, outwardly directed, generally ]-shaped connector flange portion 184 provided at the distal end of the horizontal leg 186 thereof. The horizontal leg 186 preferably flushly abuts the adjacent gasket lock flange portion 94 or 96 of the flange 86 or 88 of the inside primary part 68 of the rafter 48. The inside sealing gasket 154 or 156 is carried by the gasket lock flange portion 182 of the filler element 180 rather than by the gasket lock flange portion 94 or 96. The connector flange portion 184 preferably interlockingly engages the gasket lock flange portion 94 or 96. A sealant layer 190, e.g. a silicone layer, is preferably provided between the abutting and engaging surfaces of the gasket lock flange portion 94 or 96 and the filler element 180.

Figure 7:
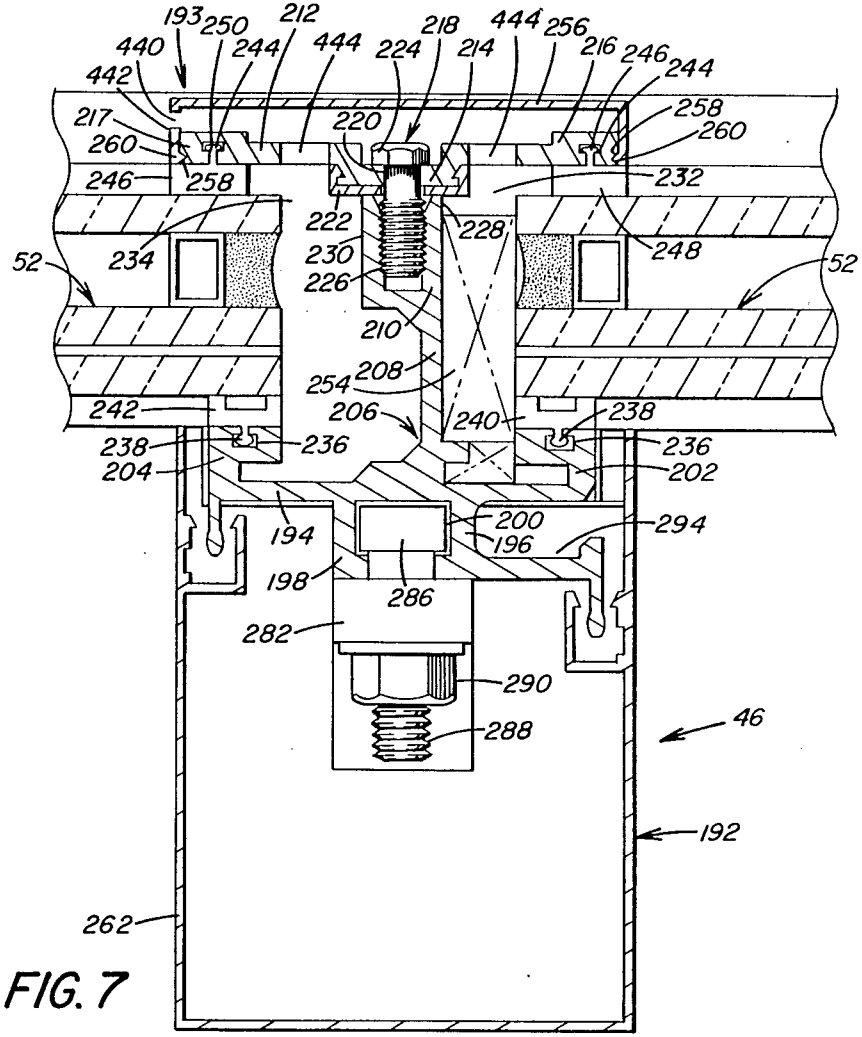
FIG. 7 is a transverse, cross-sectional view of a purlin incorporating features of this invention, and employed in the sloped glazing system shown in FIG. 1.

A preferred embodiment of a purlin 46 constructed in accordance with this invention is shown in FIG. 7. The purlin 46 is there shown to be comprised of two main or primary pieces or parts 192 and 193, one on the inside of the panels 52 and one on the outside of the panels 52, respectively. However, the purlins 46 may suitably be of any convenient construction, e.g. one piece or multiple piece construction.

As shown in FIG. 7, the inside primary part 192 of the purlin 46 comprises a horizontally elongated generally plate-like member 194. However, the inside primary part 192 configuration is not limiting to the invention. For example, the member 194 may have a generally tubular, I-, or H- shaped transverse cross-section, or any other appropriate configuration. The inside primary part 192 preferably further includes a pair of downwardly depending, spaced, opposed, horizontally elongated, generally L-shaped flanges 196, 198, integrally formed or otherwise provided on the bottom or inside surface of the plate-like member 194. The opposed L-shaped flanges 196, 198 define a horizontally elongated fastener seating channel 200 for facilitating interconnection of the purlins 46 to the rafters 48 at the rafter-purlin crossings, in a preferred manner, as will be hereinafter described. The member 194 is preferably further provided with upturned, horizontally elongated gasket lock flanges 202, 204 at opposite ends thereof. Yet further, the member 194 is preferably provided with a horizontally elongated connector flange 206. The connector flange 206 preferably comprises an upstanding, horizontally elongated wall or web 208 having a preferably integrally formed, horizontally elongated, generally channel-shaped fastener spline 210 extending along its upper or outer edge.

The outside primary part 193 of the purlin 46 comprises, as shown in FIG. 7, a horizontally elongated plate-like member 212 having a central recessed portion 214 and inturned gasket lock flanges 216, 217 formed at opposite side edges of the member 212. The inside primary part 192 and the outside primary part 193 of the purlin 46 are interconnected or joined together by means of a plurality of fasteners, e.g. cap screws 218, inserted through a plurality of aligned openings 220 provided through the central recessed portion 214 of the member 212 and a thermal isolator strip 222 interlockingly connected to the central recessed portion 214 between the portion 214 and the fastener spline 210. The thermal isolator strip 222 is made of any convenient thermally non-conductive material, such as PVC or the like, to minimize building 20 heat or energy loss through the purlins 46. However, the provision of the thermal isolator strip 222 is not limiting to this invention. The cap screws 218 include a head portion 224 which seats within the central recessed portion 214 and a threaded shank portion 226 which extends downwardly through the aligned openings 220 and into the fastener spline 210. The cap screws 218 may be self-tapping or the fastener spline 210 may be machine-threaded to threadingly receive the shank portion 226. In the embodiment of the invention depicted in FIG. 7, the cap screws 218 are self-tapping and are provided at appropriate intervals along the length of the fastener spline 210. Additionally, the inner, upper edge of the opposed walls 228, 230 forming the channel of the channel-shaped fastener spline 210 are preferably chamfered or bevelled to help start the threading of the fastener spline when self-tapping screws are employed. However, the type of means employed to connect the outside primary part 193 of the purlins 46 to the inside primary part 192 is not limiting to the invention.

The inside and outside primary parts 192, 193 of the purlin 46 define horizontally extending or horizontal glazing pockets 232, 234 therebetween, adjacent to opposite sides of the connector flange 206. The horizontal glazing pockets 232, 234 are adapted to receive horizontal marginal edge portions of vertically adjacent ones of the panels 52. The gasket lock flanges 202, 204 of the inside primary part 192 are each provided with a keyway-like slot 236 adapted to interlockingly engage key-like projections 238 provided on resilient, horizontally elongated glazing or sealing gaskets 240, 242. The gasket lock flanges 216, 217 of the outside primary part 193 are each provided with a keyway-like slot 244 adapted to interlockingly engage key-like projections 246 provided on resilient, horizontally elongated glazing or sealing gaskets 248, 250. The tightening force applied to the cap screws 218 to interconnect the inside and outside primary parts 192, 193 compressively biases or urges the outer sealing gaskets 248, 250 to bear inwardly and seal against the outer surface of the horizontal marginal edge portions of the vertically adjacent panels 52, and urges the inner sealing gaskets 240, 242 to bear outwardly and seal against the inner surface of the horizontal marginal edge portions of the vertically adjacent panels 52, to securely retain the horizontal marginal edge portions of the panels 52 within the horizontal glazing pockets 232, 234. The outer sealing gaskets 248, 250 serve to minimize penetration of moisture, air, dust, dirt, or the like from the outside of the sloped glazing system 22 to the inside of the horizontal glazing pockets 232, 234. The inner sealing gaskets 240, 242 serve to minimize penetration of moisture, air, or the like from the horizontal glazing pockets 232, 234 to the interior of the building 20.

Referring still to FIG. 7, at least the upstream horizontal glazing pocket 232 of each of the purlins 46 is preferably provided with resilient glazing or setting blocks 254 at appropriately spaced intervals to support the lower or bottom peripheral edge of the adjacent panel 52. The type or number of setting blocks 254 employed is not limiting to the invention. For example, setting blocks 254 constructed of dense [(e.g. 85±5 durometer (Shore A)] neoprene or other convenient material, may suitably be employed. It is recommended that the length of the setting blocks 254 be approximately 0.1 inch (0.254 cm.) per square foot (929 cm.$^2$) of glass panel area, but not less than 4 inches (10.16 cm.). Further, each purlin 46 is preferably provided with an outside trim cover element 256 to protect the cap screws 218 and to enhance the aesthetic appearance and weathertight integrity of the sloped glazing system 22. The trim cover elements 256 may be of any convenient type, style, or configuration, and may be fastened to the purlins 46 in any convenient manner. A preferred trim cover element 256 is generally U-shaped and is adapted to be snap-locked to the associated purlin 46. For example, opposite outer surfaces of the member 212 of the outside primary part 193 are provided with detents or recesses 258 adapted to interlockingly engage inturned ridges 260 provided on the inner surface of the U-shaped trim cover element 256 at the opposite marginal ends thereof. Similarly, inside trim cover elements 262 may also be provided for covering the inside primary part 192 of the purlins 46.

Referring again to FIG. 1, the sloped glazing system 22 of this invention preferably comprises a plurality of rafters 48 and purlins 46 interconnected together to form the framing grid 44 defining the plurality of glazing openings 50. The purlins 46 and rafters 48 cooperatively function to securely hold the panels 52 within the glazing openings 50. Each of the rafters 48 preferably extend continuously over the upwardly sloping vertical dimension of the sloped glazing system 22. However, this feature is not limiting to the invention. For example, some or each of the rafters 48 may extend instead over only a portion of the vertical dimension of the sloped glazing system 22. In the latter instance, two or more rafters 48 may be internally spliced or interconnected together in any other convenient manner along the vertical dimension of the system 22, e.g. such as is taught in U.S. Pat. No. 3,522,684, the teachings of which are herein incorporated by reference. In any event, the gasket lock flange portions 94, 96 of the inside primary part 68 of the rafters 48 are milled out, cut out, coped out, notched out, or otherwise interrupted at each of the rafter-purlin crossings to accommodate interconnection of the rafters 48 and purlins 46 at their crossings. The rafters 48 preferably are provided with a plurality of discontinuous or discrete connector strips 110. Each connector strip 110 preferably extends between vertically adjacent rafter-purlin crossings. The distance or space between vertically adjacent connector strips 110 must be sufficient to accommodate a crossing purlin 46.

The purlins 46 may extend continuously along the horizontal dimension of the sloped glazing system 22. However, many sloped or skylight glazing systems have a horizontal dimension of a magnitude so great as to preclude the feasibility of utilizing purlins which extend completely over the horizontal dimension. The purlins 46, in the latter instance, can be completely discrete, or alternatively, continuous over one or more of the rafters 48. By completely discrete, it is meant that the purlins 46 extend only between horizontally adjacent rafter-purlin crossings.

Figure 8:
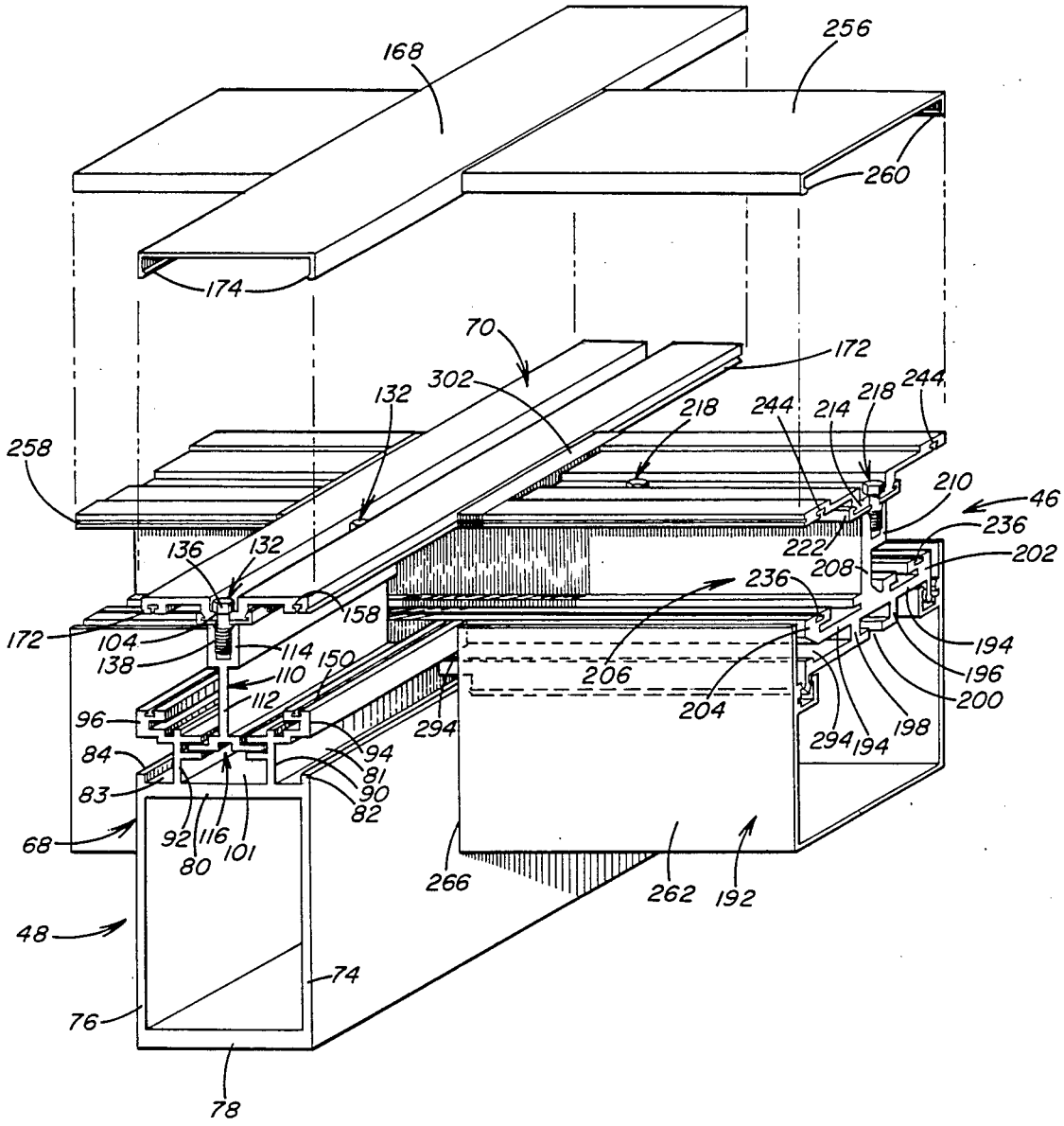
FIG. 8 is a perspective view of a typical rafter-purlin crossing of the sloped glazing system shown in FIG. 1.
Figure 9:
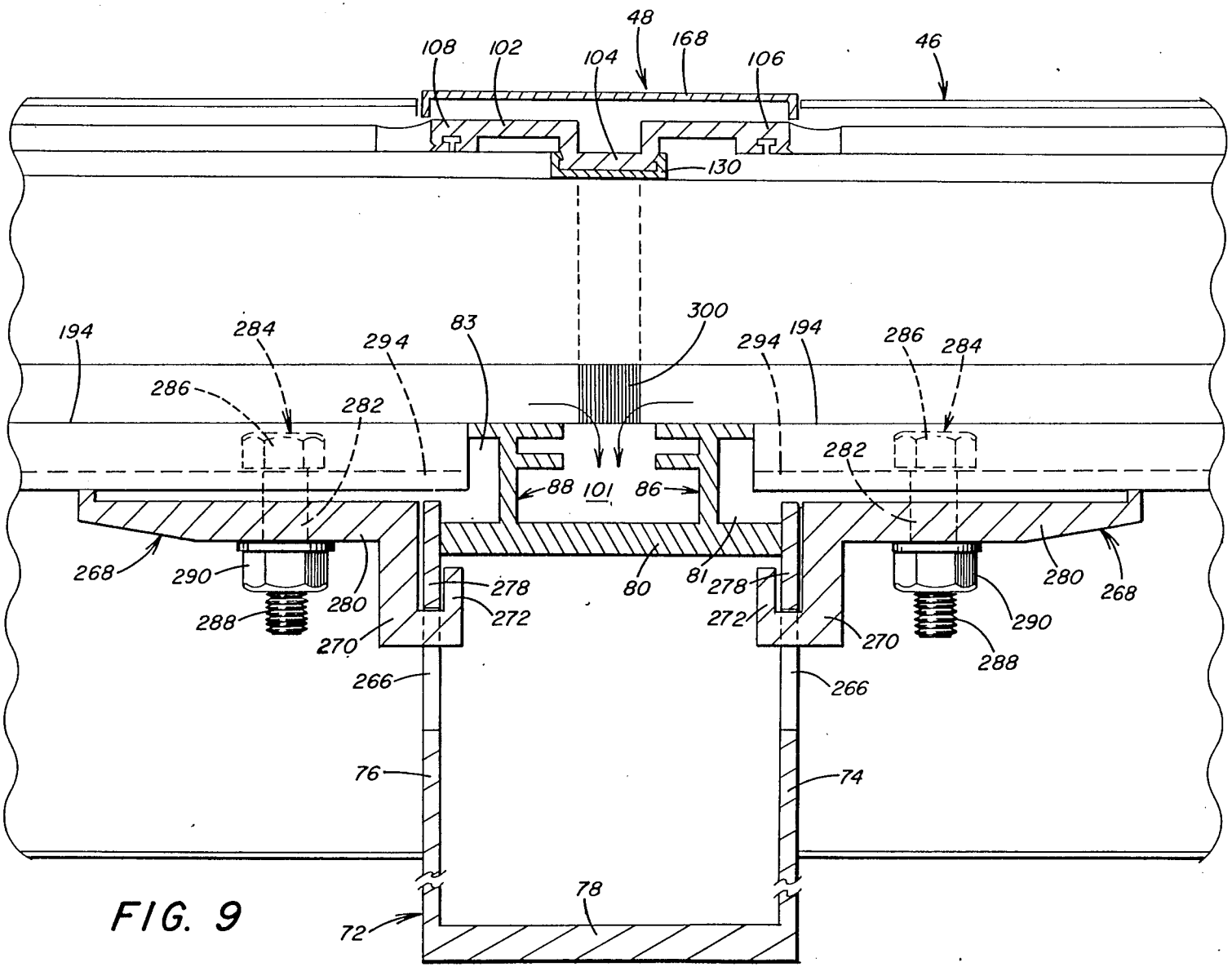
FIG. 9 is a transverse, cross-sectional view of the rafter-purlin crossing depicted in FIG. 8.

Referring additionally to FIG. 8, there can be seen a typical rafter-purlin crossing of the sloped glazing system 22, wherein a continuous or partially continuous purlin 46 extends over a rafter 48. The rafter 48 is preferably provided with oppositely disposed bracket mounting openings or holes 266 through the opposed, upstanding side walls 74, 76 of the inside primary part 68 thereof, adjacent to the space between the vertically adjacent connector strips 110. The holes 266 are preferably located above the neutral axis of the rafter 48, e.g. through the upper one-third portion thereof. As can be seen in FIGS. 8 and 9, the mounting holes 266 are each adapted to receive therethrough a hook-like projection 272 provided at the bottom edge of downwardly depending leg 270 of generally L-shaped attachment clip or mounting bracket 268. The hook-like projections 272 are adapted to engage/abut the inside surfaces 278 of the upstanding side walls 74, 76. The main leg 280 of each mounting bracket 268 is provided with an aperture 282 aligned with the fastener seating channel 200 of the inside primary part 192 of the purlin 46. Headed bolts 284 or any other convenient fastening means are then employed to securely interconnect the rafter 48 to the purlin 46. Each headed bolt 284 comprises a head portion 286 seated within the fastener seating channel 200 of a purlin 46 and a downwardly extending, threaded shank portion 288 passing through the aperture 282 of mounting bracket 268 and threadingly engaging a washer and nut assembly 290 which is tightened against the underside of the main leg 280 of the mounting brackets 268, to thereby securely interconnect the purlin 46 to the rafter 48. The outside trim cover element 256, the outside primary part 193, and the fastener seating channel 200 of the continuous or partially continuous purlin 46 are milled out, cut out, coped out, notched out, or otherwise interrupted at the rafter-purlin crossing to accommodate the interconnection of the rafter 48 to the purlin 46. The manner of crossing and/or attaching the purlins 46 and the rafters 48, however, is not limiting to the invention. For example, other types of suitable interconnection facilities are taught in U.S. Pat. Nos. 3,522,684; 4,050,201; 4,070,806; 4,114,330; 4,448,001; and 4,055,923, which teachings are herein incorporated by reference.

Figure 10:
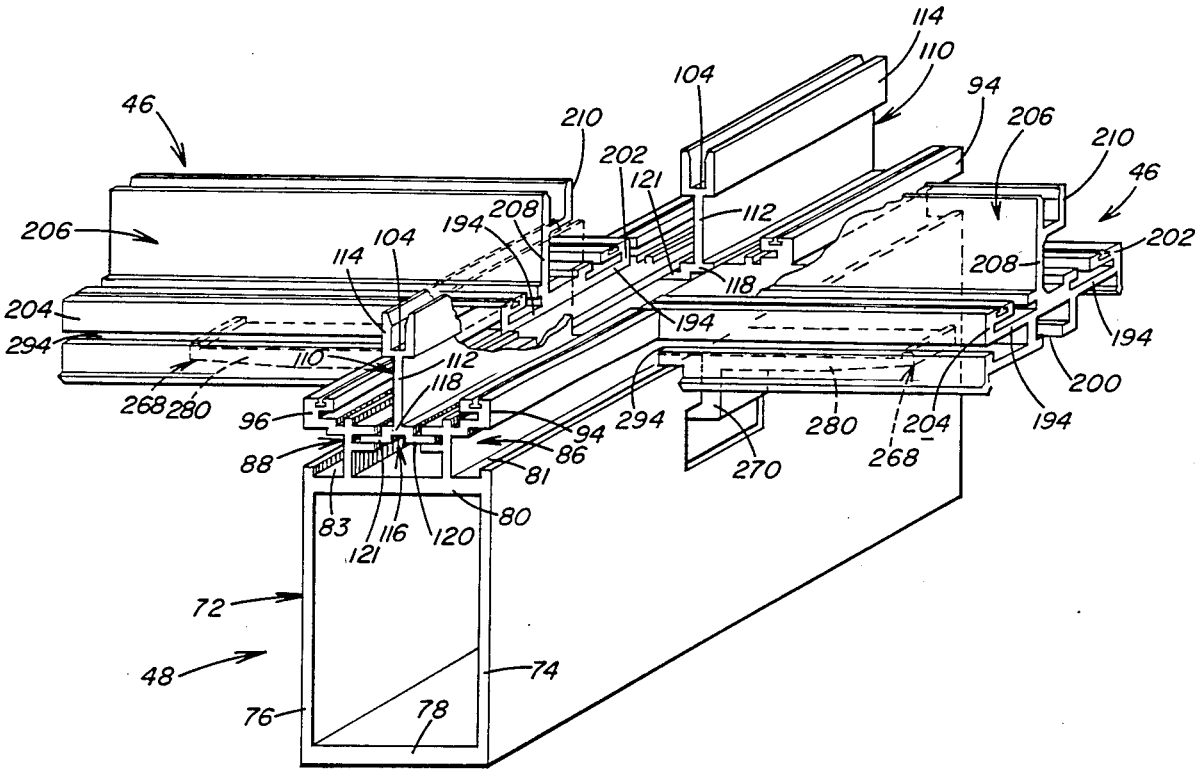
FIG. 10 is a perspective view of another rafter-purlin crossing of the sloped glazing system of FIG. 1, wherein the purlins are discrete.

Referring also now to FIG. 10, there can be seen another typical rafter-purlin crossing of the sloped glazing system 22, wherein horizontally adjacent discrete purlins 46 are attached or interconnected to the rafter 48 in the same manner as the rafter 48 is interconnected to the purlin 46. At this crossing, the distance or space between ends of horizontally adjacent, discrete purlins 46 is made to be preferably approximately equivalent to the width of drainage channel 101.

Referring to FIGS. 8–10, there is shown a preferred manner of putting the horizontal glazing pockets 232, 234 in fluid communication with substantially or semi-enclosed rafter drainage channels 101 defined by the flange 116 of the connector strips 110, the flanges 86, 88, and the outer end wall 80 of the structural portion 72 of the rafters 48. The drainage channel 101 of each rafter 48 is put in fluid communication with the vertical glazing pockets 142, 144 at each rafter-purlin crossing due to the space which occurs between vertically adjacent ones of the connector strips 110. The horizontal glazing pockets 232, 234 of the discrete purlins 46 are put in fluid communication with the drainage channel 101 of each rafter 48 with which they intersect, by virtue of the inside primary part 192 of the purlins 46 extending just over or immediately adjacent to the drainage channel 101 at the rafter-purlin crossings, as can be clearly seen in FIG. 10. The horizontal glazing pockets 232, 234 of purlins 46 extending continuously over one or more rafters 48 are put in fluid communication with the drainage channel 101 of each rafter 48 which they cross over, by virtue of at least one opening 300 provided through the member 194 of the inside primary part 192 of the purlins on both sides of the connector flange 206, as can be clearly seen in FIGS. 8 and 9. The openings 300 are preferably directly aligned with the drainage channel 101. As shown in FIGS. 8 and 10, a sealant layer 302, or weatherstripping or the like, may be inserted between the outside primary part 70 of the rafters 48 and the outside primary part 193 of the purlins 46 to minimize infiltration of moisture, air, dirt, dust and the like into the interior of the rafters 48 and purlins 46 at the rafter-purlin crossings.

Referring to FIG. 7, each purlin 46 is preferably further provided with a horizontally elongated condensation trough or gutter 294 formed along the outer surface of the upstream L-shaped flange 198 of the fastener seating channel 200. The purlin condensation gutters 294 are adapted to receive and collect any condensation which may occur on the inner surface of the adjacent panel 52. The condensation gutter 294 is milled out or terminated at the rafter-purlin crossings to accommodate the interconnection of the rafters 48 and purlins 46. Referring additionally to FIGS. 8 and 10, the purlin condensation gutters 294 extend over the upstanding lip portions 82, 84 of the rafter condensation gutters 81, 83, but terminate short of the flanges 86, 88. In this manner, the purlin condensation gutters 294 are put in fluid communication with the rafter condensation gutters 81, 83.

Referring again to FIG. 1, the sloped glazing system 22 is attached to the building 20 in any convenient manner which ensures the structural integrity of the sloped glazing system 22 and the weathertight integrity of the interior of the building 20. In the example of FIGS. 1 and 2, the endmost rafters **48*a* and 48*b* are structurally attached to the third and fourth vertical walls 30, 32, respectively, of the building 20, and the uppermost purlin or header 46*a* is structurally attached to the second vertical wall 28 of the building 20. Further, a sill 306 is provided to seal off the bottom end of the rafters 48 and to receive, collect, and dispose of the moisture accumulated within the rafter drainage channels 101 and the rafter condensation gutters 81, 83. The sill 306 is structurally attached to the concrete curb 35 of the first vertical wall 24. The means for and manner of attaching the endmost rafters 48*a* and 48*b*, the header 46*a*, and the sill 306 to the building 20 is not limiting to the invention. The various arrangements taught in U.S. Pat. Nos. 4,070,806 and 4,114,330 are typical, suitable ways to attach the sloped or overhead/skylight glazing system to the building 20**.

Figure 11:
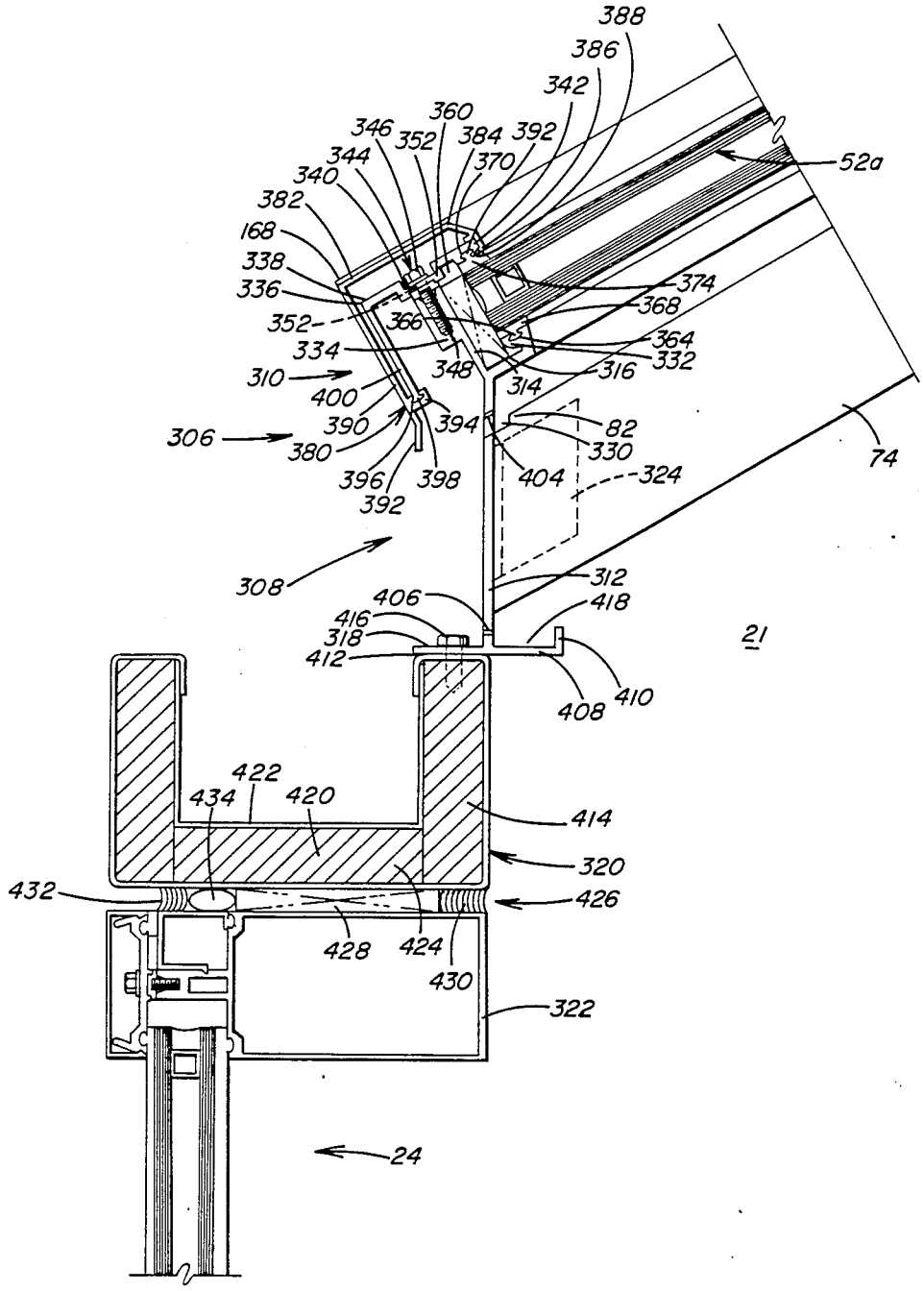
FIG. 11 is a transverse, cross-sectional view of the sill condition of the sloped glazing system of FIG. 1.

The sill 306 preferably includes facilities for separately draining the rafter condensation gutters 81, 83 and the rafter drainage channels 101. Referring now to FIG. 11, a preferred embodiment of the sill 306 includes an inside primary part 308 and an outside primary part 310. The inside primary part 308 preferably includes a horizontally elongated plate 312 having outwardly and inwardly angularly projecting flanges 314, 316, respectively, formed at the upper end thereof, and a transverse flange 318 formed at the lower end thereof. The sill 306 is attached to an external or building gutter 320 which is mounted on the curb 35 of the first vertical wall 24 of the building 20 or alternatively, as shown in FIG. 11, directly upon the header 322 of the first vertical wall 24 when it comprises a vertical curtainwall, e.g. the type taught in U.S. Pat. No. 4,055,923, or the type sold by PPG Industries, Inc. under their trademark PPG 70 WALL SYSTEM. The sill 306 is also attached to each of the rafters 48, e.g. by means of angle brackets 324, or any other convenient attachment means, e.g. thrust anchors (not shown). The lower or bottom end of each rafter 48 is angle-cut to flushly abut the inside surface of the plate 312 and the inside surface of the flange 316. The rafter condensation gutters 81, 83 are notched out near the bottom end of each rafter 48 to provide moisture escape openings 330. Further, a suitable sealant layer (not shown), e.g. made of silicone or the like, is interposed between the bottom edges of each rafter 48 and the inside surfaces of the plate 312 and the flange 316.

Referring still to FIG. 11, the inwardly, angularly projecting flange 316 of the inside primary part 308 is provided with an inturned gasket lock flange 332 at its distal end. The outwardly, angularly projecting flange 314 is provided with a generally channel-shaped fastener spline 334 at the upper end of its outer surface. The outside primary part 310 of the sill 306 preferably includes a horizontally elongated, generally L-shaped, plate-like member 336 having an upwardly sloping plate part 338 provided with a central, recessed portion 340 and an inturned gasket lock flange 342 at its distal end. A plurality of cap screws 344, or any other convenient fastener means, are employed at appropriately spaced intervals to interconnect the inside and outside primary parts 308, 310 of the sill 306. The cap screws 344 each have a head portion 346 which seats within the central, recessed portion 340 and a threaded shank portion 348 which extends through aligned openings 350 provided through the central, recessed portion 340 and a thermal isolator strip 352 which is interlockingly connected to the underside of the central, recessed portion 340 between the fastener spline 334 and the recessed portion 340. The thermal isolator strip 352 is constructed of a thermally non-conductive material, e.g. PVC. However, the provision of the thermal isolator strip 352 is optional and not limiting to the invention. The cap screws 344 may be self-tapping or the fastener spline 334 may be machine-threaded to threadingly receive the shank portion 348. In the embodiment shown in FIG. 11, the cap screws 344 are self-tapping. The inner, upper edge of the opposed walls forming the channel of the channel-shaped fastener spline 334 are preferably chamfered or bevelled to help start the threading of the fastener spline 334 when self-tapping screws are employed. However, the means employed to connect the outside primary part 310 to the inside primary part 308 is not limiting to the invention. Moreover, the construction of the sill 306 is not limiting to the invention, e.g. the sill may be comprised of a single piece or multiple pieces.

The inside and outside primary parts 308, 310, and the inner, planar surface of the flange 314 define a horizontally extending or horizontal glazing pocket 360 for receiving the bottom, horizontal marginal edge portions of the bottommost panels 52*a*. A plurality of suitable (e.g. dense neoprene) glazing or setting blocks 362 are provided at appropriately spaced intervals within the horizontal glazing pocket 360 to support the bottom edges of the panels 52*a*.

The gasket lock flange 332 of the inside primary part 308 is provided with a keyway-like slot 364 adapted to interlockingly engage a key-like projection 366 provided on resilient, horizontally elongated glazing or sealing gasket 368. The gasket lock flange 342 of the outside primary part 310 is provided with a keyway-like slot 370 adapted to interlockingly engage a key-like projection 372 provided on resilient, horizontally elongated glazing or sealing gasket 374. The tightening force applied to the cap screws 344 to interconnect the inside and outside primary parts 308, 310 of the sill 306 compressively biases or urges the outer sealing gasket 374 to bear inwardly and seal against the outer surface of the bottom, horizontal marginal edge portion of the horizontally adjacent, bottommost panels 52*a*, and urges the inner sealing gasket 368 to bear outwardly and seal against the inner surface of the bottom, horizontal marginal edge portion of the panels 52*a*, to securely retain the panels 52*a* within the horizontal glazing pocket 360. The outer sealing gasket 374 serves to minimize penetration of moisture, air, dust, dirt, or the like from the outside of the sloped glazing system 22 to the inside of the horizontal glazing pocket 360. The inner sealing gasket 368 serves to minimize penetration of moisture, air, dust, dirt, or the like from the horizontal glazing pocket 360 to the interior of the building 20. The outer and inner sealing gaskets 374, 368 can be constructed of any convenient weatherproofing material, such as, for example, neoprene or silicone. The type of sealing gaskets employed is not limiting to the invention. For example, the sealing gaskets 374, 368 may suitably be of the drive-in, wedge-type, or any other convenient type or form of weatherstripping and/or caulking material.

Referring still to FIG. 11, the sill 306 preferably further includes an outside trim cover element 380 of generally L-shaped profile. The upwardly sloping portion 382 of the trim cover element 380 has an inturned flange 384 formed at its distal end. The flange 384 is provided with an inturned ridge 386 adapted to interlockingly engage a groove 388 provided along the upper surface of the gasket lock flange 342 of the member 336. The inwardly, downwardly projecting portion 390 of the trim cover element 380 has a drip and rain shield flange 392 depending vertically downwardly from its distal end, and a boss 394 having a kerf 396 formed therein extending along a lower, inner marginal edge portion thereof. The kerf 396 of the boss 394 interlockingly engages a thickened portion 398 provided along the bottom edge of downwardly, inwardly sloping plate part 400 of the plate-like member 336 of the outside primary part 310 of the sill 306. Further, the outer wall of the outside trim cover element 168 of each of the rafters 48 preferably extends over the outer wall 382 of the outside trim cover element 380 of the sill 306, to ensure proper runoff of moisture therefrom.

The plate 312 of the sill 306 is provided with a plurality of spaced-apart openings 404 near its upper end and a plurality of spaced-apart openings 406 near its lower end. The upper openings 404 are aligned with the drainage channel 101 of the rafters 48. The transverse flange 318 of the inside primary part 308 of the sill 306 has an inside portion 408 having an upturned flange 410 formed along its distal edge, and an outside portion 410 extending over and supported by the upper surface 412 of the inner edge wall 414 of the building gutter 320. A plurality of anchor bolts 416 or any other convenient attachment means, are provided at appropriately spaced intervals along the outside portion 410 of the transverse flange 318 to interconnect the sill 306 to the building gutter 320. The lower openings 406 provided through the plate 312 of the sill 306 are disposed adjacent to the sill condensation gutter 418 formed by the inside portion 408 and the upturned flange 410 of the transverse flange 318.

The building gutter 320, as shown in FIG. 11, is generally channel-shaped. The gutter 320 may be constructed of formed steel or extruded aluminum, and may be provided with a thermal insulation layer 420 to minimize energy losses in the building 20 interior. The building gutter 320 may also be lined with a suitable gutter liner material 422, e.g. stainless steel or neoprene, to minimize corrosion thereof. As shown in FIG. 11, the bottom wall 424 of the gutter 320 is mounted to the header 322 of the first vertical wall 24 of the building 20 by means of a mounting layer 426. The mounting layer 426 comprises a spacer block 428 made of any convenient material, e.g. dense neoprene, and inner and outer sealant beads 430, 432, respectively. A backer rod 434 made of, e.g., closed-cell polyurethane, is disposed between the spacer block 428 and the outer sealant bead 432, in order to impart the desired profile to the outer sealant bead 432. The mounting layer 426 also serves to minimize penetration of moisture, air, dust, dirt, or the like into the building interior 21. The building gutter 320 forms no part of the present invention and is not limiting thereto. Moreover, any suitable water disposal facilities may be employed in lieu of, or in addition to, the gutter 320.

The moisture control mechanism of the sloped glazing system 22 of the present invention works in the following described manner to provide systematic, separate zonal collection and drainage of all infiltration and condensation moisture from the sloped glazing system 22 to water disposal facilities, such as the building gutter 320, disposed externally thereof. Any moisture which leaks past the outside sealing gaskets 160, 162 into the vertical glazing pockets 142, 144 of a rafter 48 flows downwardly along the flange 116 of connector element 110 due to gravity and the sloped contour or configuration of the rafters 48. When the infiltrated moisture reaches the next lower rafter-purlin crossing, it flows into the drainage channel 101 by virtue of the opening created by the space between vertically adjacent connector elements 110. All of the moisture which intrudes the vertical glazing pockets 142, 144 of each rafter 48 is likewise conducted into the continuously extending drainage channels 101. Further, any moisture which leaks past the outer sealing gaskets 248, 250 of a discrete purlin 46 into the horizontal glazing pockets 232, 234, flows out of the ends of the purlin 46, at the rafter-purlin crossings and into the rafter drainage channels 101. In the instance of continuous purlins, the intruded moisture is discharged through the openings 300 provided through the inside primary part 192 of the purlins 46 at the rafter-purlin crossings, and into the drainage channels 101. In this manner, all of the intruded water present throughout the sloped glazing system 22 is zonally collected in the rafter drainage channels 101. All of the thusly collected intruded water is then discharged from the bottom end of the rafter drainage channels 101, through the upper openings 404 provided through the plate 312 of the sill 306, and into the building gutter 320 or any other suitable water disposal facility.

Yet further, all of the condensation moisture collected within the purlin condensation gutters 294 is discharged at the rafter-purlin crossings, into the rafter condensation gutters 81, 83 to join the condensation moisture collected directly in the rafter condensation gutters 81, 83. All of the thusly collected condensation moisture is then discharged from the bottom end of the rafter condensation gutters 81, 83 through the moisture escape openings 330, down the side walls 74, 76 of the structural portion 72 of the rafters 48, and into the sill condensation gutter 418. The condensation moisture collected within the sill condensation gutter 418 may be allowed to remain therein to be evaporated, or preferably, as shown in FIG. 11, may be discharged through the lower openings 406 provided through the plate 312 of the sill 306, and into the building gutter 320 or any other suitable water disposal facility.

Another preferred feature of the present invention is the utilization of the theory of "rain screen and pressure equalization" to minimize intrusion of moisture from the outside to the inside of the sloped glazing system 22 or the building 20. Accordingly, the purlins 46 are provided with a plurality of spaced-apart openings or pressure equalization vents 440 through the lower or downstream face 442 of the outside trim cover elements 256, and a plurality of spaced-apart openings or pressure equalization vents 444 through the member 212 of the outside primary part 193 of the purlins 46. The vents 440 and 444 are preferably offset from each other to enable air but prohibit moisture from intruding the horizontal glazing pockets 232, 234 via the vents 444. For example, but not limiting to the invention, the vents 444 may be provided at the midpoint between rafter-purlin crossings and the vents 440 may be provided at the quarter points between rafter-purlin crossings. In this manner, the pressure between the air inside of the horizontal glazing pockets 232, 234 and the outside/ambient atmosphere are allowed to equalize. Further, since the horizontal glazing pockets 232, 234 communicate with the vertical glazing pockets 142, 144 at the rafter-purlin crossings, the air pressure inside of the vertical glazing pockets 142, 144 and the ambient air pressure are also equalized. Yet further, the upper openings 404 provided through the sill plate 312 are shielded from moisture intake by the drip and rain shield flange 392 of the sill trim cover element 380, but allowed to intake atmospheric air in order to help equalize the air pressure within and without the sloped glazing system 22. However, the lower openings 406 are each preferably provided with a check valve (not shown) to block or prohibit intake of air or moisture from the ambient air. The check valves are preferably sealingly mounted within the lower openings 406. The check valves are preferably one-way check valves which allow moisture to be discharged from the sill condensation gutter 418 to the building gutter 320 but which prohibit air or moisture to flow therethrough into the interior 21 of the building 20. The rain shield and air equalization feature of the sloped glazing system 22 minimizes negative pressure development within the system which, if not minimized, would draw moisture into the vertical and horizontal glazing pockets.

Many other modifications to and/or variations of the basic inventive concepts herein taught, which may appear to those skilled in the pertinent art, are encompassed within the spirit and scope of this invention, which should be interpreted solely on the basis of the following claims.

What is claimed is:

1. A sloped curtainwall system for a building or the like, comprising:

at least one panel having an inner surface facing the building interior and an opposite outer surface with the outer surface having vertical and horizontal marginal edges and the innner surface having vertical and horizontal marginal edges;

a plurality of elongated rafters;

a plurality of purlins;

means for interconnecting said rafters and purlins to provide a grid having at least one opening for receiving said panel;

at least one of said rafters having:

an enclosed chamber extending along its length;

a first bearing and sealing means engaging outer vertical marginal edge is said panel;

a second bearing and sealing means engaging inner vertical marginal edges of said panel;

said first and second bearing and sealing means engaging said panel minimizes movement of moisture, air, dust and the like from the building exterior to the building interior around the vertical marginal edges of said panel; and said first and second bearing and sealing means defining a vertical pocket in fluid communication with said enclosed chamber and including a vertical condensation gutter for receiving and collecting moisture from the interior surface portion of the curtainwall system;

at least one of said purlins having a horizontal pocket defined by means for engaging and outer horizontal marginal edge portions of said panel and at least one of said purlins having a horizontal condensation gutter for receiving and collecting moisture from the interior surface portions of the curtainwall system;

means for providing fluid communication between said enclosed chamber and horizontal pocket of said at least one of said purlins to move moisture from the horizontal pocket to said enclosed chamber;

means for providing fluid communication between said horizontal and vertical condensation gutters, said fluid providing means located in close proximity to rafter-purlin crossing;

sill means interconnecting adjacent ones of said rafter and sealing off bottom edge portions of said rafters, said sill means having an opening in fluid communication with said chamber and a condensation gutter in fluid communication with said vertical condensation gutter;

means interconnecting said vertical pocket or said horizontal pocket and exterior of the curtainwall system for pressure equalization;

a first trim cover element secured to said first bearing and sealing means of said at least one of said rafters:

a second trim cover element secured to outer portion of said means for engaging inner and outer horizontal marginal edge portions of said panel; and wherein said means interconnection said vertical pocket or said horizontal pocket and exterior of the curtainwall system for pressure equalization includes a first hole in said first or said second cover element and a second hole in first bearing and sealing means or in said outer portion of said means for engaging inner and outer horizontal marginal edge portions of said panel, said first and second holes being offset from one another and check valves in said first or second holes.

* * * * *

UNITED STATES PATENT AND TRADEMARK OFFICE

CERTIFICATE OF CORRECTION

PATENT NO. : 4,680,905

DATED : July 21, 1987

INVENTOR(S) : James A. Rockar

It is certified that error appears in the above-identified patent and that said Letters Patent is hereby corrected as shown below:

Title page:

In line 1 of the Abstract, "sloper" should be "sloped".

Claim 1 (column 19, line 26), insert "inner" after "engaging".

Signed and Sealed this

Third Day of May, 1988

*Attest:*

*Attesting Officer*

DONALD J. QUIGG

*Commissioner of Patents and Trademarks*